United States Patent [19]

Sherwin

[11] 3,962,504

[45] June 8, 1976

[54] SELF-ATTACHING TILE OF A FIRED CERAMIC TILE BODY

[75] Inventor: Christopher John Sherwin, Newcastle, England

[73] Assignee: H & R Johnson-Richards Tiles Limited, Tunstall, England

[22] Filed: Oct. 23, 1975

[21] Appl. No.: 624,872

Related U.S. Application Data

[63] Continuation-in-part of Ser. No. 496,549, Aug. 12, 1974, abandoned, which is a continuation-in-part of Ser. No. 307,402, Nov. 17, 1972, abandoned.

[52] U.S. Cl. ..... 428/40; 428/49; 428/167; 52/125; 52/288; 52/309; 52/390; 52/420; 52/746

[51] Int. Cl.[2] ..... B32B 3/00; C09J 7/02; E04B 5/00; E04F 13/08

[58] Field of Search ..... 428/40, 49, 167; 52/125, 173, 309, 304, 390, 391, 380, 420, 746, 302

[56] References Cited

UNITED STATES PATENTS

| | | | |
|---|---|---|---|
| 973,243 | 10/1910 | Wille | 52/391 |
| 2,637,995 | 5/1953 | Mann | 52/125 |
| 2,970,124 | 1/1961 | Drummond | 52/390 X |
| 3,065,235 | 10/1968 | Makray | 52/309 X |
| 3,088,588 | 5/1963 | Feichter et al. | 52/390 X |
| 3,270,473 | 9/1966 | Smith | 52/390 |
| 3,408,250 | 10/1968 | Finefrock | 52/288 X |

*Primary Examiner*—Philip Dier
*Attorney, Agent, or Firm*—Marshall & Yeasting

[57] ABSTRACT

Fired ceramic tiles having a rear surface which is provided with a series of fine ribs but is otherwise substantially planar are attachable to a wall or similar surface, without the need to apply a fixative to the surface, by reason of a plurality of bodies of adhesive material distributed over the rear surface of the tile body and projecting therefrom to a thickness of 0.75 to 1mm., the adhesive being a pressure-sensitive adhesive and being of such a nature that it will retain its coherent form both prior to and after mounting of the tile and will not flow or spread appreciably, each body of adhesive extending over a plurality of said ribs which are embedded therein, having a flat outer surface and being spaced from adjacent bodies of adhesive and from the edges of the tile body, and the adhesive material being protected by a peel-off film.

2 Claims, 1 Drawing Figure

SELF-ATTACHING TILE OF A FIRED CERAMIC TILE BODY

This is a continuation in part of application Ser. No. 496549 filed Aug. 12, 1974 now abandoned, which in turn is a continuation-in-part of application Ser. No. 307402 filed Nov. 17, 1972 now abandoned.

The invention relates to ceramic tiles and especially to self-attaching ceramic tiles.

The usual method of mounting ceramic tiles in position upon a surface is to coat the surface with a cementitious or other fixative and apply the tiles to the fixative. For the sake of convenience in description the surface to which the tiles are applied will be referred to herein as a wall, but this term is not used restrictively; it will be appreciated that tiles may be fixed to various types of surfaces and structural elements in vertical or other positions and the invention is applicable to any of them.

The conventional method of attaching ceramic tiles to surfaces by means of an adhesive layer applied to the surface suffers from a number of disadvantages. In the first place the adhesive layer is sticky and inconvenient to apply; adhesive frequently attaches to the front surfaces of the tile and to the person fixing the tiles and the operation is time-consuming and hence expensive. Moreover since the adhesive requires some time to set after application fixing tiles is a skilled operation particularly on vertical surfaces and it is not possible to apply grouting compositions to the gaps between adjacent tiles until the adhesive has hardened.

In order to overcome these difficulties efforts have been made to produce ceramic tiles pre-coated with an adhesive so that the tiles can simply be pressed into contact with an underlying surface without previously coating the undelying surface with a bonding medium. It has therefore been proposed to coat the entire rear surface of the tile with an adhesive medium but this presents a number of problems. In the first place a ceramic tile having its entire rear surface pre-coated with an adhesive is very awkward and messy to handle because the user in handling such a tile invariably places his fingers on the adhesive coating. In addition the surfaces to which tiles are adhered generally present small irregularities and a problem arises in accommodating such irregularities since the tiles themselves will not flex and there is a tendency for adhesive displaced from high spots on the surface to exude at the sides of the tile which is a nuisance and increases the time required to fix tiles in that this excess adhesive requires to be removed. Further problems arise in that most adhesives will not retain their adhesive properties for any length of time so that by the time such precoated tiles come to be applied to a wall or other surface the adhesive is ineffective. Problems also arise in achieving a satisfactory bond between the back face of the tile and the adhesive medium.

It is an object of the present invention to provide a self-attaching ceramic tile in which all or most of the above disadvantages are removed.

The invention provides a self-attaching tile comprising a fired ceramic tile body having a rear surface which is provided with a series of fine parallel ribs but is otherwise substantially planar, a plurality of bodies of adhesive distributed over the rear surface of the tile body and projecting therefrom to a thickness of 0.75 to 1mm., the adhesive being a pressure-sensitive adhesive and being of a nature which retains said thickness of projection both prior to and after mounting of the tile without substantial flowing or spreading, each body of adhesive extending over a plurality of said ribs which are embedded therein, having a flat outer surface and being spaced from adjacent bodies of adhesive and from the edges of the tile body, and a peel-off film extending over said bodies of adhesive.

It should be appreciated that the term "pressure-sensitive adhesive" is used herein to refer to an adhesive medium which achieves an adhesive bond with a surface solely by application of pressure as distinct from adhesives which require to cure, set or air dry by loss of water or solvent either at room temperature or at elevated temperatures.

The pattern of the adhesive areas may vary but in a preferred arrangement it comprises a series of parallel strips of adhesive extending across the back of the tile from near one edge to near the opposite edge.

It is envisaged that for the best results some at least of the adhesive areas should be situated near to but spaced from the margins of the tile and that they should be of sufficient thickness to compensate for reasonable inequalities between the mating faces of the wall and the tile. Wall surfaces commonly present minor irregularities whose extent is likely to vary with different types of surface. For instance if it is desired to afix tiles on an already tiled surface an adhesive projection of no more than 0.4mm. may be adequate, whereas in other cases a thickness of between 0.75 and 1mm. or more is preferable. It is therefore a feature of the invention that the adhesive thickness should be between 0.75 and 1mm. to enable fixing to all normal wall surfaces.

One form of tile is illustrated by way of example in the accompanying drawings, in which.

The tile A illustrated is of square shape and on its back face it is provided with a raised panel of thin raised ribs B surrounded by a plain marginal area C. This pattern is formed by the corresponding configuration of a press die when the tile is formed in a power press, usually from ceramic material in a finely divided state, commonly termed clay dust. Such tiles are usually glazed on their front faces and have spacer lugs D along some or all of their edges, though these can be omitted if desired.

After the tile has been fired in a kiln it is subjected to a further processing operation to apply a series of strips of a pressure sensitive adhesive medium E which extend across the back face of the tile, parallel with each other and with two opposite edges of the tile and have flat outer faces. As shown there are five strips E, equally spaced apart, the outer two strips being close to but spaced from the respective opposite edges of the tile with which they are parallel and the strips extending almost to the other two opposite edges of the tile. The fine ribs B are beneficial in that the adhesive medium E is keyed in position by being embedded in the ribs, each area of adhesive medium extending over several ribs.

Figure 1:
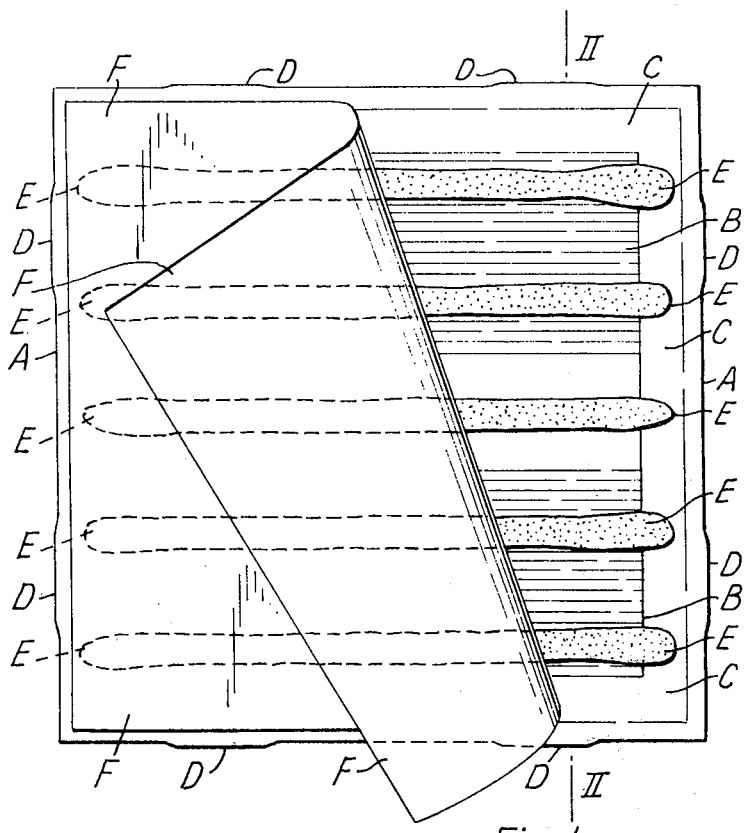
FIG. 1 is a rear elevation.
Figure 2:
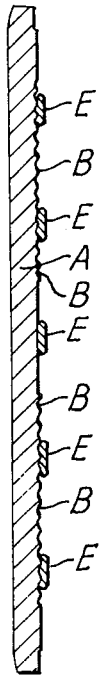
FIG. 2 is a cross-section on line II—II of FIG. 1.

When the back face of the tile has been coated with the strips of adhesive medium E a flexible film F is applied, covering the whole of the back face, and protecting the adhesive medium. This film F is shown in FIG. 1 in process of being peeled off from the tile, which would be done immediately prior to fixing the tile in position the protective film is conveniently of suitably prepared paper.

The adhesive medium must be one which retains its depth of projection above the surface of the tile, that is to say it must not flow or spread appreciably either before or after application of the tile to a surface. It must have sufficient depth of projection to compensate for the slight concavity which tiles may develop in manufacture as well as reasonable variations likely to be encountered in the various types of surface which require to be tiled.

The adhesive medium should be flexible and also have the quality of retaining its adhesive qualities substantially unimpaired at normal room temperature for an adequate period between the manufacture of the tiles and their mounting in position. In our experiments we have found a satisfactory pressure sensitive adhesive medium possessing these attributes to be a synthetic rubber and resin medium. One such medium consists of approximately 70% rosin ester and hydrocarbon resin, approximately 30% styrene butadiene rubbers, and small amounts of titanium dioxide, a fungicide and an anti-oxidant.

The invention is not restricted to any particular method of depositing the adhesive on the tile, for instance it may be applied by a hand-actuated gun or similar extrusion appliance or it may be applied automatically by means of a suitable mechanical applicator.

It will be evident that by this invention ceramic tiles are produced which can be sent out from the tile factory ready for application to a surface without the need for skilled labour, and without requiring any additional adhesive to be applied either to the surface or to the tile. The series of fine ribs on the rear surface of the fired ceramic tile are embedded in the spaced bodies of adhesive, and thus produce a satisfactory bond when the tile is applied to a surface, even though the rear surface of the tile is not entirely coated with the adhesive, and the use of spaced bodies of adhesive which is thus made possible accommodates an irregular underlying surface and enables the user to handle the tile without his fingers coming into contact with the adhesive. The flat outer surfaces of the strips of adhesive medium provide a sufficient area of contact to secure the tile firmly in place on the supporting surface and the spacing of the areas of adhesives medium enables any medium displaced by irregularities of the supporting surface to be accommodated in the spaces so that adhesive medium is not expelled at the sides of the tile.

Substantial benefits also derive from the fact that the adhesive medium is a pressure-sensitive adhesive as distinct from conventional tile adhesives which require to cure or dry by the evaporation of solvents or water after application. With such conventional adhesives the bond generated on fixing of the tile is not sufficiently strong to support the weight of tile and hence when tiling vertical surfaces it is essential to commence at the bottom so that the upper tiles are supported on the edges of the lower tiles until the adhesive dries or cures. By virtue of the use of a pressure-sensitive adhesive tiling may commence at any suitable point and the user may proceed upwards, downwards or to either side at his option since the tiles will retain their positions accurately because of the substantially instantaneous bond achieved by virtue of the pressure-sensitive adhesive. A further benefit deriving from use of a pressure-sensitive adhesive is that grouting can take place immediately whereas with adhesives which require to dry or cure grouting must be delayed until the tile adhesive has hardened.

I claim:

1. A self-attaching tile comprising a fired ceramic tile body having a rear surface which is provided with a series of fine parallel ribs but is otherwise substantially planar, a plurality of bodies of adhesive distributed over the rear surface of the tile body and projecting therefrom to a thickness of 0.75 to 1mm., the adhesive being a pressure-sensitive adhesive and being of a nature which retains said thickness of projection both prior to and after mounting of the tile without substantial flowing or spreading, each body of adhesive extending over a plurality of said ribs which are embedded therein, having a flat outer surface and being spaced from adjacent bodies of adhesive and from the edges of the tile body, and a peel-off film extending over said bodies of adhesive.

2. A tile as claimed in claim 1 in which the adhesive comprises approximately 70% of rosin ester and hydrocarbon resin and approximately 30% styrene butadiene rubbers.

* * * * *